US007521409B2

(12) United States Patent
Tuggle

(10) Patent No.: US 7,521,409 B2
(45) Date of Patent: Apr. 21, 2009

(54) MOLD REMOVAL AND CLEANING SOLUTION

(76) Inventor: Terrance T. Tuggle, 912 Webster St., Jeffersonville, IN (US) 47130

( * ) Notice: Subject to any disclaimer, the term of this patent is extended or adjusted under 35 U.S.C. 154(b) by 433 days.

(21) Appl. No.: 11/266,342

(22) Filed: Nov. 4, 2005

(65) Prior Publication Data

US 2006/0100121 A1 May 11, 2006

Related U.S. Application Data

(60) Provisional application No. 60/732,667, filed on Nov. 3, 2005, provisional application No. 60/625,161, filed on Nov. 5, 2004.

(51) Int. Cl.
*C11D 3/395* (2006.01)
*C11D 3/39* (2006.01)

(52) U.S. Cl. ..... 510/199; 510/302; 510/303; 510/109

(58) Field of Classification Search ..... 510/424, 510/302, 303, 109, 199
See application file for complete search history.

(56) References Cited

U.S. PATENT DOCUMENTS 4,071,463 A * 1/1978 Steinhauer ..... 510/370
4,097,395 A * 6/1978 Posey et al. ..... 134/2
4,898,681 A * 2/1990 Burton ..... 424/665
4,941,988 A * 7/1990 Wise ..... 510/222
5,192,459 A * 3/1993 Tell et al. ..... 424/665
5,229,027 A * 7/1993 Ahmed ..... 510/221
5,281,280 A * 1/1994 Lisowski et al. ..... 134/26
5,510,047 A * 4/1996 Gabriel et al. ..... 510/221
5,567,247 A * 10/1996 Hawes et al. ..... 134/36
5,911,909 A * 6/1999 Coyle-Rees ..... 252/187.25
6,083,422 A * 7/2000 Ambuter et al. ..... 252/187.26
6,303,556 B1 * 10/2001 Kott et al. ..... 510/357
6,444,634 B1 * 9/2002 Mason et al. ..... 510/376
6,762,160 B2 * 7/2004 Barbeau et al. ..... 510/161
2004/0038843 A1 * 2/2004 Busch et al. ..... 510/311

FOREIGN PATENT DOCUMENTS

JP 2002363017 A * 12/2002
JP 2003040715 A * 2/2003

OTHER PUBLICATIONS

Derwent abstract of JP 2003040715 A, Inoue.*
Derwent abstract of JP 2002363017 A, Inoue.*

* cited by examiner

*Primary Examiner*—Mark Eashoo
*Assistant Examiner*—Jane L Stanley
(74) *Attorney, Agent, or Firm*—John S. Hale; Gipple & Hale

(57) ABSTRACT

A solution containing an inorganic hypochlorite in aqueous solution and an acetic acid and citric acid mixed with water which when applied to mold bearing surfaces removes mold without harming the surfaces of the object being cleaned and remains active preventing mold growth for a long period of time.

17 Claims, No Drawings

MOLD REMOVAL AND CLEANING SOLUTION

RELATED APPLICATIONS

Related applications are U.S. Provisional Application Ser. No. 60/625,161 filed Nov. 5, 2004 and U.S. Provisional Application Ser. No. 60/732,667 filed Nov. 3, 2005 from which priority is claimed.

FIELD OF INVENTION

The present invention is generally directed toward a mold and mildew cleaning and removal composition which is applied to a surface having organic biological colonies present on the surface.

BACKGROUND OF THE INVENTION

This invention generally relates to the art of disinfecting and more particularly to cleaning inanimate objects with an aqueous hypochlorite solution which retains its fungicidal activity for a significant period of time.

Numerous compositions containing hypochlorite are known for treating a surface so as to prevent or remove unwanted biological material. Hypochlorite solutions have been used for many years as germicides, sporicides, virucides and chemical warfare decontamination. However, their prior use has been generally limited due to the inherent corrositivity of hypochlorites and the relatively short effective life span when the same is used to clean and disinfect inanimate objects.

1. Field of the Invention

The present invention relates to a process for applying an alkali-metal hypochlorite aqueous solution combined with acetate and citrate salts to remove and destroy fungus and bacteria and a composition for same.

Sodium, potassium, lithium, and calcium hypochlorites are well known for their disinfecting and bleaching properties.

The aqueous hypochlorite solution of the instant invention is useful for removing and destroying mold, mildew, slime and algae on various surfaces, including but not limited to natural and painted/stained wood, aluminum and vinyl siding, brick, grout, stone, cement, stucco, ceramic tile, and the like and for structural items such as boats, machinery and roofs. The term mildew is used to refer generally to undesirable micro organisms which grow on surfaces including mold and algae and combinations of same.

2. Discussion of the Prior Art

Prior art in this area is exemplified by U.S. Pat. No. 4,097,395 issued Jun. 27, 1978 which discloses a mold and mildew removal composition utilizing bleach, water and acetic acid and by U.S. Pat. No. 3,717,580 issued Feb. 20, 1973, which is directed toward a disinfecting decontaminating solution comprising citrate and hypochlorite. The novel feature of this solution is its "ability"to self-destruct after a short period of germicidal activity with the stated advantage that such a system allows use of a powerful disinfectant such as sodium hypochlorite to be used on sensitive materials without undue exposure of the treated surface to the disinfectant.

The use of citrates and malates as disclosed in the aforementioned '580 patent, destroys residual hypochlorite on treated materials and it does not permit control or prolonging of the contact time.

U.S. Pat. No. 5,281,280 issued Jan. 25, 1994 discloses the use of an aqueous solution for removing mildew, mold and algae from various types of surfaces. The solution contains sodium hypochlorite ranging from 2.75% to 4.0% by weight, sodium bicarbonate, and about 0.5-5% d-limonene in various ratios. The d-limonene acts as both a degreasing agent and an odor masking agent which covers the sodium hypochlorite odor. The composition was found to be effective against microorganisms such as mildew, molds and algae. An alternative embodiment, #6004 Citrus can be substituted for the d-limonene at a percentage of 0.5% by weight.

It can thus be seen that there is a need for a long lasting composition which will remove existing mold and algae and prevent regrowth of the same on the surface which has been cleaned.

SUMMARY OF THE INVENTION

The present invention is directed toward a composition for removing mold from articles comprising an aqueous solution of inorganic hypochlorite, the salt being NaClO ranging in weight from about 0.5% to about 6% by weight of the composition, combined with a citrate salt ranging from 0.05% to about 6.9% by weight of the composition and an acetate salt ranging from about 0.02% to about 3.2% by weight of the composition added to water. The composition is applied to the surface to be cleaned and then rinsed off with a water wash.

Accordingly, one object of this invention is to provide a method of disinfecting and cleaning materials harboring mold and mildew using a new aqueous hypochlorite containing composition.

Another object of this invention is to provide a new aqueous hypochlorite containing a number of acids which synergistically work together to prevent reoccurrence of mold and mildew and removal of same.

Another object of this invention is to provide a new aqueous hypochlorite containing a number of salts which synergistically work together to prevent reoccurrence of mold and mildew and removal of same.

A still further object of this invention is to provide hypochlorite containing composition which remain fungicidal active for a long period of time.

Another object of this invention is to provide a composition which is characterized by economy and simplicity of manufacture and ease of use.

It is another object of this invention to provide an aqueous disinfectant solution containing an organic sodium hypochlorite salt and an acetic acid and citric acid which synergistically interact to provide a long lasting effective fungicide and cleaner.

It is still another object of the invention to provide a composition which works immediately on contact to remove mildew and/or mold from a variety of surfaces.

It is yet another object of the invention to provide a composition which leaves no visible film on a treated surface and does not damage the surface.

It is also another object of the invention to provide a composition for removing mold and mildew which is suitable for everyday use.

These and other objects, advantages, and novel features of the present invention will become apparent when considered with the teachings contained in the detailed disclosure.

DESCRIPTION OF THE INVENTION

A number of tests were performed on raw wood, painted wood, brick, mortar, cement and siding as well as other surfaces as noted in the field of the invention to demonstrate the efficiency of the desired ranges of the components of the inventive compositions on different surfaces. Ambient temperature was maintained during the tests and all of the tests resulted in removal of the mildew/mold with no damage to treated surface.

At this point, it should be noted that hypochlorite (bleach) by itself is known to kill mold and mildew; however, when bleach is applied to a mildewed surface, although it kills mold and mildew, it does not remove the whole mold and mildew colony. Indeed, at times, mold and mildew that has been killed with bleach is often visible, and a discoloration often appears on a mildewed surface treated with bleach. Furthermore, at other times, only the pigmented spore structure of the surface is killed, and while visibly decolorized and seemingly clean, the base of the mold and mildew colony has not been effectively killed allowing the mold and the mildew to grow back after only a short period of time. The cleaning with bleach is effective for only a short period of time after which the mold and mildew grows back upon the surface.

The mold and mildew remover of the present invention, however, not only kills all of the mold and mildew but removes it without abrasive scrubbing. Indeed, a major advantage of the mold and mildew remover of the present invention is that its use eliminates the need to hand scrub a surface. When the teachings of the present invention are followed, the oxidizing agent, namely, the bleach as enabled by the acetate and citrate salts or by the acetic acid and citric acid, not only kills the mold and mildew but also enables the remover to dissolve and remove it to produce a visibly clean surface.

In accordance with the present invention, the preferred organic acids components for incorporation into the mold and mildew remover concentrate are acetic acid and citric acid which together form the organic acid ingredients in the concentrate. Facts influencing the choice of the acetate and citrate salts are their water solubility as well as their synergistic effect with hypochlorite.

The preferred inorganic hypochlorite salts are sodium, calcium, potassium and lithium. However, the hypochlorite NaClO is preferably used to provide the disinfectant qualities of solution composition since it is generally known that the hypochlorite ion is the source of the active disinfecting agent and not the cation.

It is also envisioned, but not necessary, to also add a detergent or detergent mixture to the disinfecting solution for the purpose of enhancing wetting. Any anionic or non-ionic surfactant may be used for this purpose but one should not use cationic surfactants. The surfactant which is preferably used is an anionic surfactant such as sodium dodecyl diphenyloxide disulfonate which is manufactured by the Dow Chemical Company under the trademark DOEFAC 2A1. Generally, the detergent may be present for about 0.2% to about 0.6% by weight but, in any event, the amount used is not critical. When the two organic acids or salts are added to the composition, the pH has a value which is slightly higher than the commercially available hypochlorite solutions.

The present inventive composition is an aqueous solution containing a bleach or hypochlorite ranging from about 0.5% to about 6.0% by weight of the composition combined with acetic acid ranging from 0.02% to 2.0% by weight and citric acid ranging from 0.03% to 3.0% by weight or acetate salts ranging from 0.02% to 3.2% by weight and citrate salts ranging from 0.05% to 6.9% by weight with the remaining percentage by weight being water.

If desired, a stabilizer for the bleach in the form of alkyl benzene sulfate is commercially available from the Dow Corning Chemical Company which can be used in a range of about 0.02% to about 0.30% by weight to provide for bleach stability. Other additives which can be used are alkali metal alkyl sulfates and alkyl aryl sulfonates.

Fragrance may be added to the formulation.

A preferred embodiment and best mode of the invention is sodium hypochlorite ranging from about 2.6% to about 6.0% by weight of the composition having from about 0.1% to about 1.1% sodium acetate salt by weight of the composition and from about 0.2% to about 2.4% sodium citrate salt by weight of the composition with the remaining percentage by weight being water. A surfactant and fragrance can be added as desired. While the acetate and citrate salts are noted as being a sodium inorganic salt, it is envisioned that calcium, potassium and lithium could be substituted for the sodium portion of the respective salt.

The most preferred embodiment is sodium hypochlorite ranging from about 4.0% to about 6.0% by weight of the composition and from 0.17% to 0.25% sodium acetate salt by weight of the composition and from 0.39% to about 0.54% sodium citrate salt by weight of the composition with the remaining percentage by weight being water.

Typical formulations of the present hypochlorite solution are as follows:

EXAMPLE 1

| Formulation | Percent by weight |
|---|---|
| Sodium Hypochlorite (13%) | 39.50 |
| Acetic Acid (99%) | 0.20 |
| Citric Acid (anhy pwr) | 0.30 |
| Water | 60.00 |
| Total: | 100.00 |

EXAMPLE 2

| Formulation | Percent by weight |
|---|---|
| Sodium Hypochlorite (6.5%) | 39.00 |
| Acetic Acid (99%) | 0.40 |
| Citric Acid (anhy pwr) | 0.60 |
| Water | 60.00 |
| Total: | 100.00 |

EXAMPLE 3

| Formulation | Percent by weight |
|---|---|
| Sodium Hypochlorite (13%) | 39.52 |
| Acetic Acid (99%) | 0.17 |
| Citric Acid (anhy pwr) | 0.31 |
| Water | 60.00 |
| Total: | 100.00 |

EXAMPLE 4

| Formulation | Percent by weight |
|---|---|
| Sodium Hypochlorite (13%) | 39.53 |
| Sodium Acetate | 0.21 |
| Sodium Citrate | 0.46 |
| DOWFAX 2A1 | 0.60 |
| Fragrance | 0.15 |
| Water | 59.05 |
| Total: | 100.00 |

EXAMPLE 5

| Formulation | Percent by weight |
|---|---|
| Sodium Hypochlorite (13%) | 39.53 |
| Sodium Acetate | 0.02 |
| Sodium Citrate | 0.05 |
| DOWFAX 2A1 | 0.60 |
| Fragrance | 0.15 |
| Water | 59.65 |
| Total: | 100.00 |

EXAMPLE 6

| Formulation | Percent by weight |
|---|---|
| Sodium Hypochlorite (13%) | 39.53 |
| Sodium Acetate | 2.13 |
| Sodium Citrate | 4.62 |
| DOWFAX 2A1 | 0.60 |
| Fragrance | 0.15 |
| Water | 52.97 |
| Total: | 100.00 |

EXAMPLE 7

| Formulation | Percent by weight |
|---|---|
| Sodium Hypochlorite (13%) | 19.77 |
| Sodium Acetate | 0.21 |
| Sodium Citrate | 0.46 |
| DOWFAX 2A1 | 0.60 |
| Fragrance | 0.15 |
| Water | 78.81 |
| Total: | 100.00 |

EXAMPLE 8

| Formulation | Percent by weight |
|---|---|
| Sodium Hypochlorite (13%) | 19.77 |
| Sodium Acetate | 0.63 |
| Sodium Citrate | 1.38 |
| DOWFAX 2A1 | 0.60 |
| Fragrance | 0.15 |
| Water | 77.47 |
| Total: | 100.00 |

EXAMPLE 9

| Formulation | Percent by weight |
|---|---|
| Sodium Hypochlorite | 5.14 |
| Sodium Acetate | 0.21 |
| DOWFAX 2A1 | 0.60 |
| Water | 94.05 |
| Total: | 100.00 |

EXAMPLE 10

| Formulation | Percent by weight |
|---|---|
| Sodium Hypochlorite | 5.14 |
| Sodium Citrate | 0.46 |
| DOWFAX 2A1 | 0.60 |
| Water | 93.80 |
| Total: | 100.00 |

EXAMPLE 11

| Formulation | Percent by weight |
|---|---|
| Sodium Hypochlorite | 5.14 |
| Sodium Acetate | 0.21 |
| Sodium Citrate | 0.46 |
| DOWFAX 2A1 | 0.60 |
| Water | 93.59 |
| Total: | 100.00 |

TABLE I

| Component | Example 4 Formulation | Broad Range | Preferred | Most Preferred |
|---|---|---|---|---|
| Sodium Acetate | 0.21 | 0.02-3.2 | 0.1-1.1 | 0.17-0.25 |
| Sodium Citrate | 0.46 | 0.05-6.9 | 0.2-2.4 | 0.38-0.54 |
| NaOCl* | 5.2 | 0.5-6 | 2-6 | 4-6 |

The formulations of this composition have been used to clean mold and mildew from cut lumber, aluminum and vinyl siding, cement, stone, bricks, grout and the like and to prevent mold growth for up to one year without additional treatment. The composition was applied to the surface of the object by spraying the composition onto the surface using a standard spray bottle or by brushing the same onto the surface using a standard brush. If desired, the composition could be pressured under gas and foamed onto the surface.

The solution of Example 4 was used to remove mold and mildew from pine decking wood (approx. 10×36 inches). The solution was sprayed onto the wood under ambient conditions until the surface was thoroughly saturated and then allowed to stand on the surface. The black and green coloration of the surface began to disappear upon initial contact of the solution with the wood surface. After four minutes the surface was rinsed with flowing water and allowed to dry. No mold and mildew stains were observed on the surface.

The solutions of Examples 4, 5, and 6 were evaluated in the same manner as previously noted above (wood dimensions approximately 10×10 inches). The solution was allowed to remain on the surface for approximately six minutes before rinsing with flowing water. In Example 5, some black discoloration remained on the surface. In Example 6, no mold and mildew stains remained on the surface of the wood. Black and green coloration of the surface began to disappear upon initial contact with the solution.

The solutions of Examples 7 and 8 were evaluated in the same manner as initial Example 4 above (wood dimensions approximately 10×10 inches). The solution was allowed to remain on the surface for approximately six minutes before rinsing with flowing water. No mold and mildew stains were observed on the surface. The surface treated with the solution of Example 8 was brighter than that treated with solution of Example 7. Likewise, the black and green coloration of the surface disappeared more quickly upon initial contact with the solution of Example 8 than that of Example 7.

The solutions of Examples 9, 10, and 11 were evaluated in the same manner as noted in the first discussion of Example 4 (wood dimensions approximately 10×10 inches). In Example 9, some black discoloration remained on the surface. In Example 10, some black discoloration remained on the surface although the surface was brighter overall from that of the solution of Figure 9. In Example 11, no mold and mildew stains remained on the surface. Black and green coloration of the surface began to disappear upon initial contact with the solution.

This demonstrates the synergistic effect of sodium acetate and sodium citrate in the effective removal of mold and mildew.

The solutions of Examples 4, 7 and 8 were also used to remove mold and mildew from asphalt roofing material (approx. 4×4 feet). The solution was sprayed onto the roofing material under ambient conditions until the surface was thoroughly saturated and then allowed to stand on the surface. The black coloration of the surface began to disappear upon initial contact of the solution with the roofing material. After five minutes for the solution of Example 4 and after ten minutes for the solutions of Examples 7 and 8, the surfaces were rinsed with flowing water and allowed to dry. No mold and mildew stains were observed on the surfaces.

Similarly, the solutions of Examples 4, 7, and 8 were used to effectively remove mold and mildew stains from stucco, vinyl and aluminum siding, wood fencing, brick, mortar, grout, tile and shower surfaces.

After application, the composition was allowed to remain on the surface from about 1 minute to 2 minutes depending upon the density of the mold and/or mildew and then rinsed off with ordinary tap water.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims.

What I claim is:

1. A composition for removing mold from articles comprising an aqueous solution containing an inorganic hypochlorite ranging from about 0.5% to about 6.0% by weight of the composition, a citrate salt ranging from 0.2% to about 2.4% by weight of the composition and an acetate salt ranging from about 0.1% to about 1.1% by weight of the composition and the remainder of the composition being water.

2. The composition of claim 1 further comprising a pH of about 12.0.

3. The composition of claim 1 wherein said composition additionally contains a surfactant.

4. The composition of claim 3 wherein said surfactant is an anionic surfactant.

5. The composition of claim 4 wherein said anionic surfactant is sodium dodecyl diphenyloxide disulfonate ranging from about 0.2% to about 0.6% in weight.

6. The composition of claim 1 wherein said inorganic hypochlorite is selected from the group consisting of sodium hypochlorite, calcium hypochlorite and lithium hypochlorite.

7. The composition of claim 1 wherein said inorganic hypochlorite is sodium hypochlorite ranging from about 4.0% to about 6.0% in weight.

8. The composition of claim 1 further comprising a stabilizer in a quantity suitable to maintain stabilization of the hypochlorite.

9. The composition of claim 8 wherein said stabilizer is alkyl benzene sulfate ranging from about 0.02% to about 0.30% by weight.

10. The composition of claim 8 wherein said stabilizer is taken from a group consisting of alkali metal alki sulfate and alkyl sulfonates.

11. The composition of claim 1 further comprising a fragrance.

12. A composition for removing mold from articles comprising an aqueous solution containing an inorganic sodium hypochlorite ranging from about 0.5% to about 6.0% by weight of the composition, sodium citrate salt ranging from 0.39% to about 0.54% by weight of the composition and sodium acetate salt ranging from about 0.17% to about 0.25% by weight of the composition and the remainder of the composition being water.

13. The composition of claim 12 further comprising an anionic surfactant.

14. A composition for removing mold from articles comprising an aqueous solution containing an inorganic hypochlorite ranging from about 4.0% to about 6.0%, a sodium citrate ranging from 0.46% to about 1.38% by weight of the composition and a sodium acetate ranging from about 0.21% to about 0.63% by weight of the composition, the ratio of the sodium acetate to the sodium citrate ranging from about 1 to 2 to about 1 to 2.5 and the remainder of the composition being water.

15. The composition of claim 14 further comprising an anionic surfactant.

16. The composition of claim 14 wherein said inorganic hypochlorite is sodium hypochlorite.

17. A method of removing mold from a surface comprising the steps of:

(a) applying to an untreated mold and/or mildew surface a composition solution consisting essentially of about 0.5% to about 6.0% an inorganic hypochlorite salt, a citrate salt ranging from 0.05% to about 6.9% by weight of the composition and an acetate salt ranging from about 0.02% to about 3.2% by weight of the composition, the ratio of the acetate salt to the citrate salt ranging from about 1 to 2 to about 1 to 2.5 and the remainder being water;

(b) allowing the composition solution to engage the mold and surface from about 1 to 2 minutes; and (c) rinsing the surface after application with the composition solution with water.

* * * * *

UNITED STATES PATENT AND TRADEMARK OFFICE

CERTIFICATE OF CORRECTION

PATENT NO. : 7,521,409 B2
APPLICATION NO. : 11/266342
DATED : April 21, 2009
INVENTOR(S) : Terrance F. Tuggle It is certified that error appears in the above-identified patent and that said Letters Patent is hereby corrected as shown below:

Title page,
Item [76], Inventor, the middle initial of the inventor "T." should read --F.--.

Signed and Sealed this

Thirtieth Day of June, 2009

JOHN DOLL
*Acting Director of the United States Patent and Trademark Office*